US005430988A

United States Patent [19]

Gustavsson et al.

[11] Patent Number: 5,430,988

[45] Date of Patent: Jul. 11, 1995

[54] APPARATUS FOR FINAL FOLDING

[75] Inventors: Magnus Gustavsson; Thomas Bengtsson; Dan Kagg, all of Falkenberg, Sweden

[73] Assignee: Absoflex Akustik AB, Falkenberg, Sweden

[21] Appl. No.: 150,048

[22] PCT Filed: May 20, 1992

[86] PCT No.: PCT/SE92/00335

§ 371 Date: Nov. 18, 1993

§ 102(e) Date: Nov. 18, 1993

[87] PCT Pub. No.: WO92/20880

PCT Pub. Date: Nov. 26, 1992

[30] Foreign Application Priority Data

May 21, 1991 [SE] Sweden ..... 9101514

[51] Int. Cl.[6] ..... B65B 7/26

[52] U.S. Cl. ..... 53/376.4; 53/370.3; 53/372.4

[58] Field of Search ..... 53/223, 224, 370.3, 53/372.4, 376.4

[56] References Cited

U.S. PATENT DOCUMENTS 3,110,144 11/1963 Johansen et al. ..... 53/372.4
3,771,280 11/1973 Bechk ..... 53/370.3
5,311,723 5/1994 Boniani et al. ..... 53/376.4

*Primary Examiner*—W. Donald Bray
*Attorney, Agent, or Firm*—Antonelli, Terry, Stout & Kraus

[57] ABSTRACT

An apparatus for the inward or final folding of end portions of a covering on a panel (5). The covering (1) surrounds the panel (5) and extends out over one edge to such an extent that at least first inward folds (17, 18) overlap one another from two opposite edges. Second inward folds (16) from the two opposing edges are located inside the overlapping, first inward folds (17, 18). A corner support (21) is placeable in the corner for folding of the second inward fold (16) about the corner support (21), with the aid of a stirrup (38) which is switchable for inward folding of the second inward fold (16) about the corner support (21) while leaving exposed an adhesive application surface on the second inward fold (16). A first folder (43) is provided for inward folding of one first inward fold (17), and a second folder (44) is provided for inward folding of another first inward fold (18) after application of adhesive to the adhesive application surface.

10 Claims, 14 Drawing Sheets

APPARATUS FOR FINAL FOLDING

BACKGROUND OF THE INVENTION

The present invention relates to an apparatus for the final folding, or inward folding, of at least the end portion, in particular corners, of a covering on a panel, in which the covering surrounds the panel and projects out over at least one edge to such an extent that at least first inward folds from two opposing edges overlap one another, while second inward folds from the opposite edges are located inside the overlapping first inward folds.

At present, there is no suitable machine, apparatus or plant for the substantially automated covering of panels of, for example Gullfiber® or the like for use of the finished product as acoustic absorbent in different environments. The covering is normally made of fibre-glass fabric or some other suitable material. Hitherto, substantially the only solution has been manual covering of Gullfiber® panels with fibre-glass fabric. It has proved to be particularly difficult to obtain, under such circumstances, smooth and straight corners and as uniform products as possible. In many environments, extreme demands are placed on the appearance of the product. It is naturally also desirable in the art to be able to devise a machine which requires few manual operations and which may be considered as almost fully automatic.

SUMMARY OF THE INVENTION

The object of the present invention is to satisfy the above-outlined desiderata and needs.

Employing an apparatus according to the present invention, it has proved possible to be able, almost wholly without manual operations, to cover or clad Gullfiber® panels with fibre-glass fabric for realizing acoustic absorbents of extremely high standards in respect of appearance. This implies that the absorbents display substantially smooth and even surfaces and smooth and even edges as well as straight corners. It has, moreover, proved to be difficult to reveal any discrepancies between the different absorbents, their quality proving, instead, to be highly uniform. Nor does there appear to be anything which prevents the apparatus according to the present invention from being applied in other contexts in which it is desirable to achieve even and straight corners on a covering of a relatively soft panel-shaped object.

BRIEF DESCRIPTION OF THE DRAWINGS

The present invention will be described in greater detail hereinbelow, with particular reference to the accompanying Drawings. FIG. 16 is a view similar to that of FIG. 15, the upper edge flap or edge infold having been folded in.

DETAILED DESCRIPTION OF PREFERRED EMBODIMENT

Figure 1:
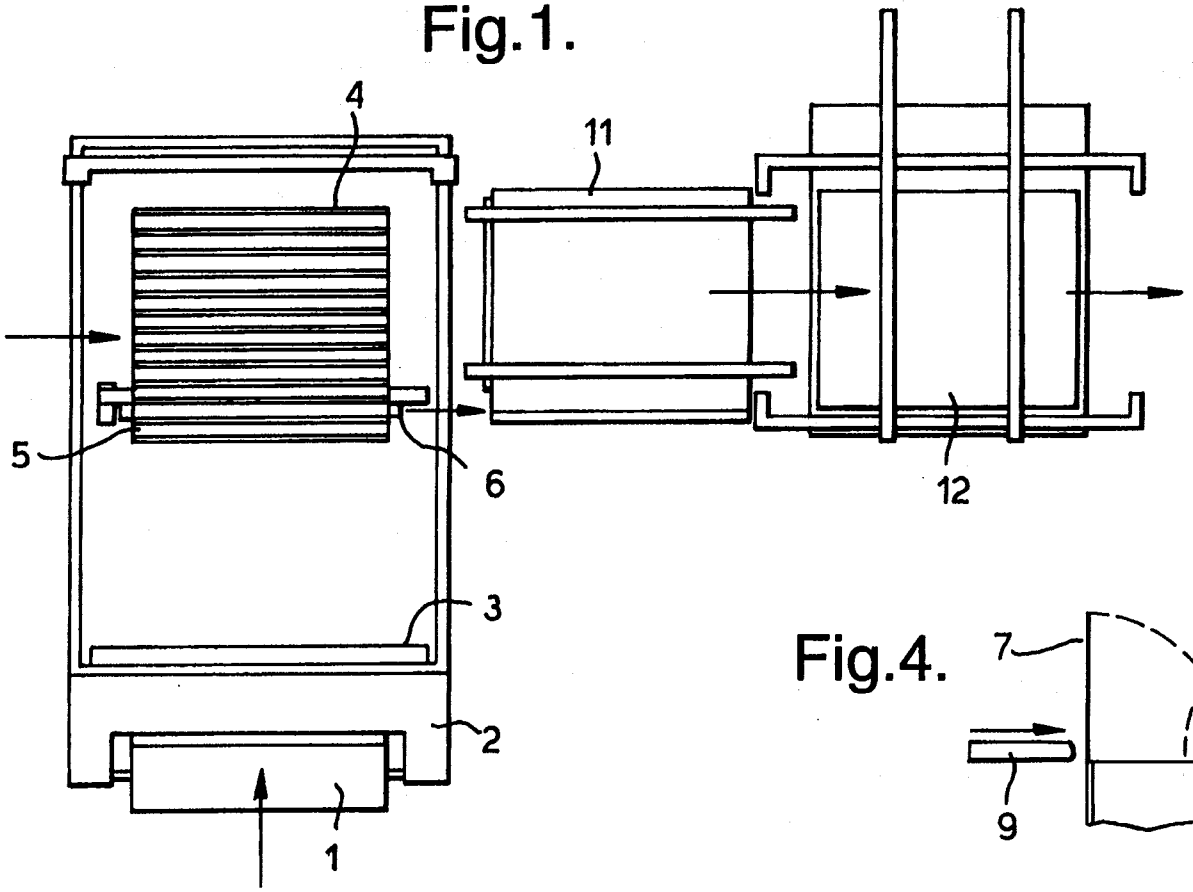
FIG. 1 shows a diagram of a plant for utilizing the present invention.
Figure 2:
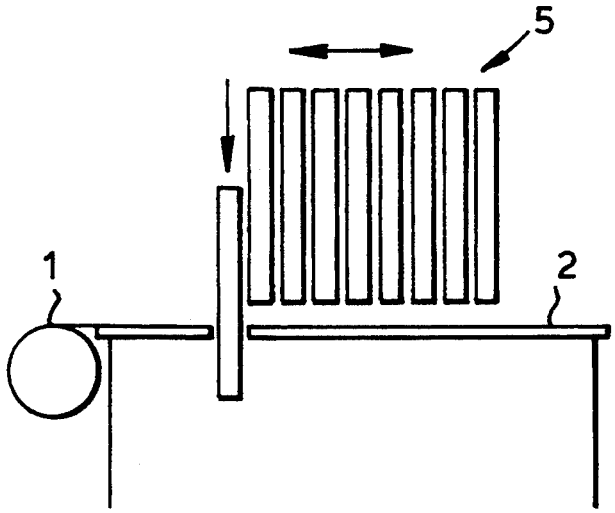
FIG. 2 is a side elevation of a fabric application table.

The embodiment shown on the Drawings of an apparatus according to the present invention is intended for covering or cladding of so-called Gullfiber® panels of dimensions of, for example, 1 200×600×50 mm. Naturally, the Gullfiber® panels may also consist of other similar fiber panels, for example mineral wool. Naturally, there is nothing to prevent panels or plates of other dimensions from being clad or covered according to the present invention. In the present embodiment, the covering or cladding consists of a fibre-glass fabric of substantially the same type as is employed for walls and the like. As illustrated in FIG. 1, the fibre-glass fabric is provided in the form of a roll 1 from which the fibre-glass fabric is drawn out across a table 2 past a cutting machine 3 and beneath a magazine 4 for a number of upright plates or panels 5. After cutting of the fibre-glass fabric by means of the cutting machine 3 in a suitable length for enclosing a panel 5, the panel 5 is pressed, together with the fibre-glass fabric, through an opening 6 in the table 2 as illustrated more clearly in FIGS. 2 and 3. The fibre-glass fabric 1 will form an edge 7 and an edge 8 on either side of one longitudinal edge of the panel 5. See FIG. 4. The one fibre-glass fabric edge 7 is folded in over the panel edge with the aid of a reciprocally displaceable folder 9. Either the fabric edge 7 or the fabric edge 8 is provided with a strand of a suitable adhesive, for example a hot melt glue, whereafter the opposing edge 8 is folded in over the already folded-in fabric edge 7 by means of a pivotal folder 10.

Figure 4:
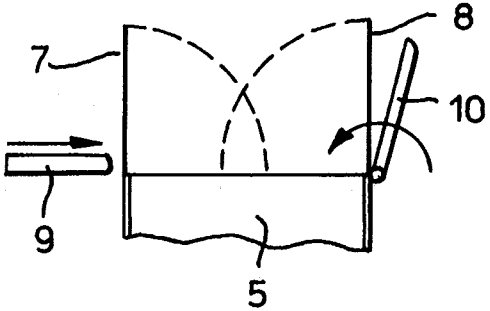
FIG. 4 is a schematic partial view of an apparatus for the inward folding of the covering on one longitudinal edge of a panel.
Figure 3:
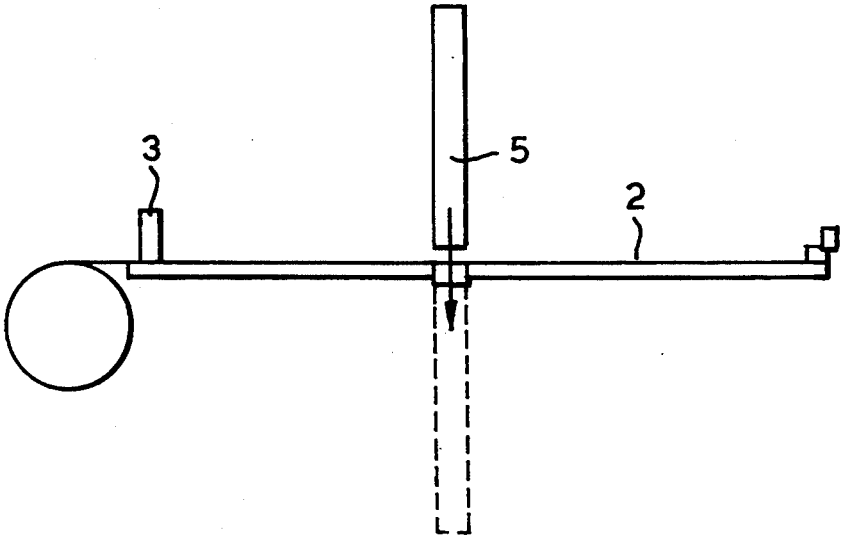
FIG. 3 shows a side elevation similar to that of FIG. 1 of another embodiment of the application table.
Figure 5:
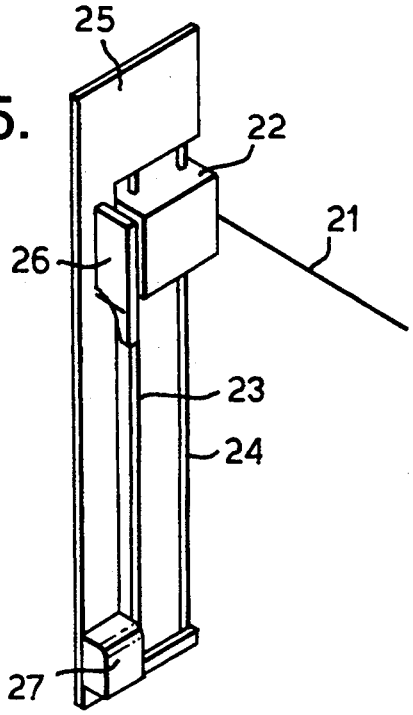
FIG. 5 is a schematic view of a corner support in the starting position.
Figure 6:
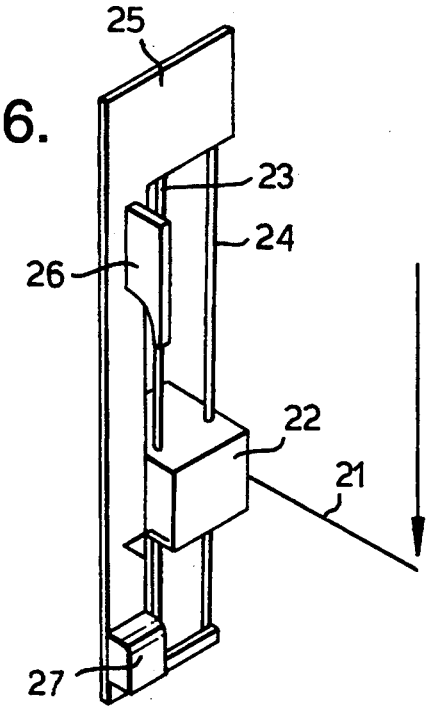
FIG. 6 is a view similar to that of FIG. 5 of the corner support on its way down in a corner.
Figure 7:
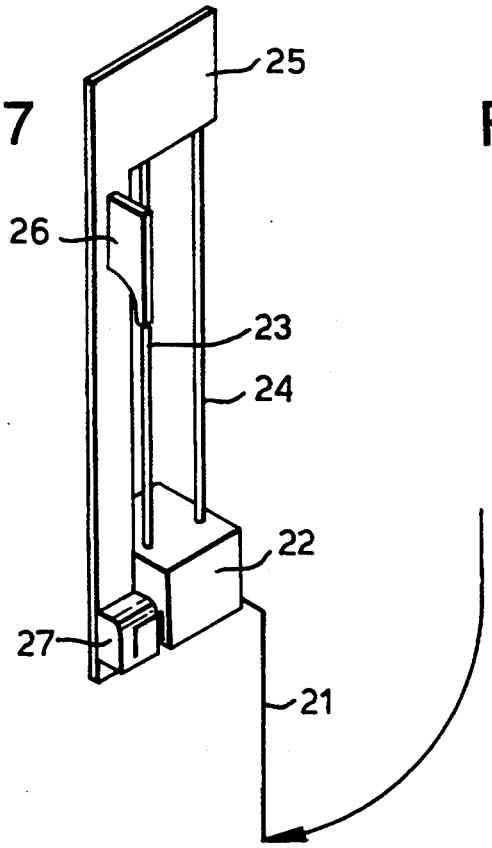
FIG. 7 is a view similar to that of FIG. 5 with the corner support in position in a corner.
Figure 8:
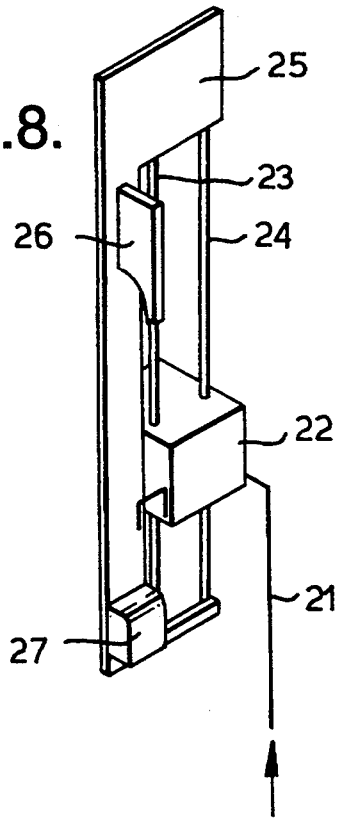
FIG. 8 is a view similar to that of FIG. 5 with the corner support on its way up out of the corner.

The fibre-glass fabric 1 is slightly wider than the length of the plates or panels 5 so that the fibre-glass fabric projects out over the ends of the plates or panels 5 substantially in the same way as the longitudinal fabric edges 7 and 8 in FIG. 4. In order that the fibre-glass fabric 1 extend as uniformly and smoothly around the panel 5 as possible once the panel 5 has been passed through the opening 6 together with the fibre-glass fabric 1, it is appropriate that the opening 6 proper in the table top 2 be of slightly conical shape, as illustrated in FIG. 3.

Figure 9:
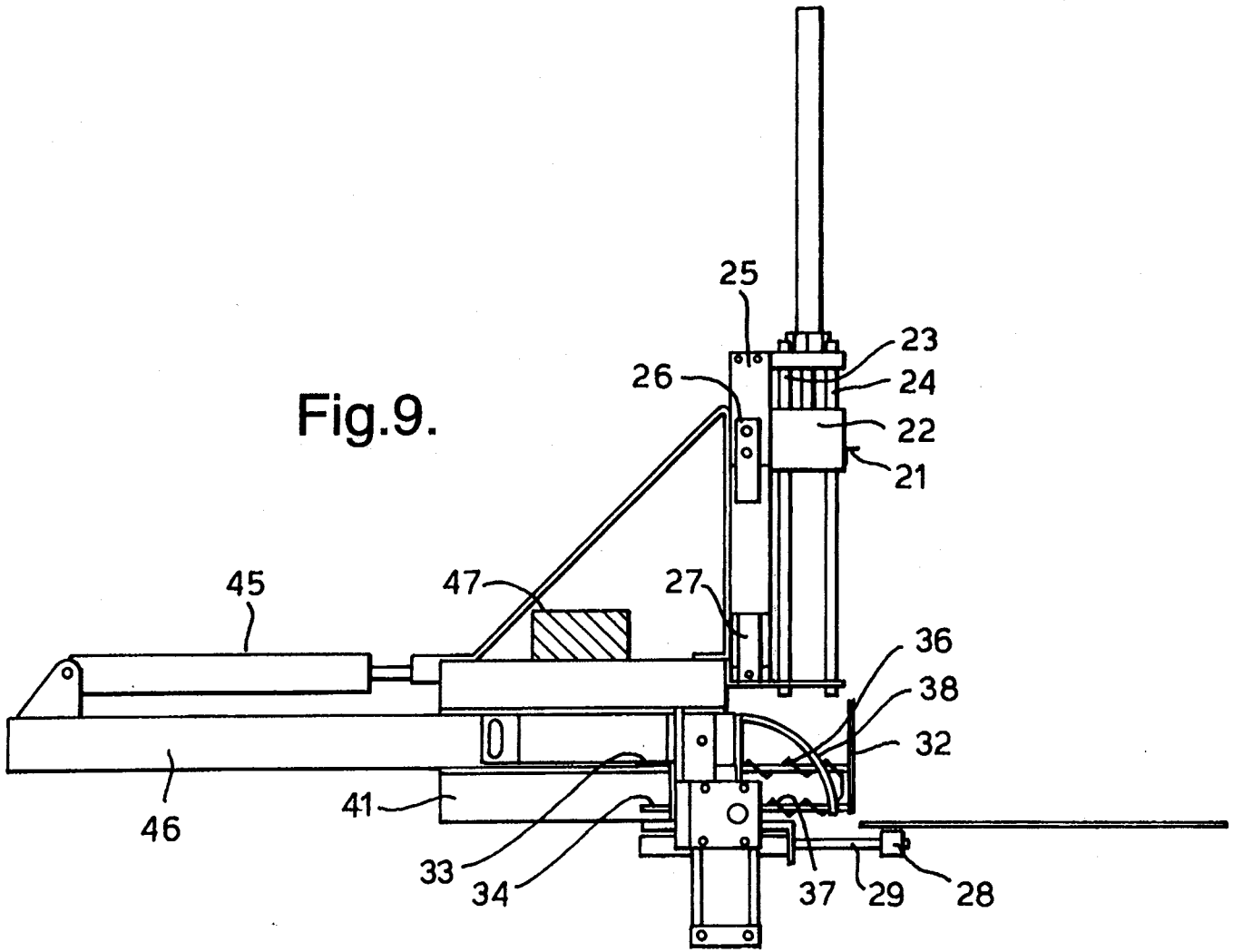
FIG. 9 shows a view of a portion of an apparatus according to the present invention which is disposed at a corner.
Figure 10:
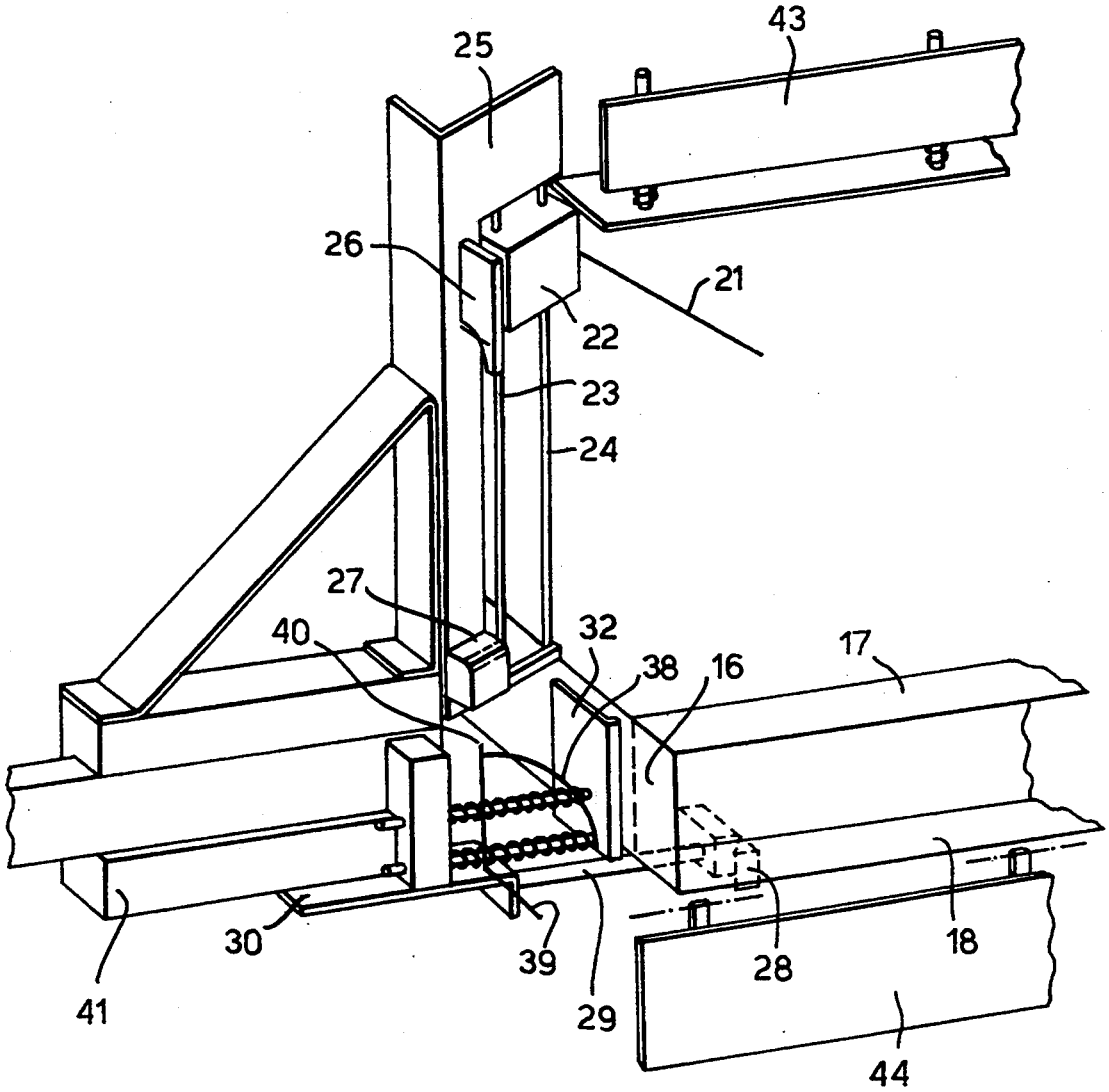
FIG. 10 shows a view, partly in perspective, of the corner portion according to the present invention, as illustrated in FIG. 9, but with the parts in starting position.
Figure 11:
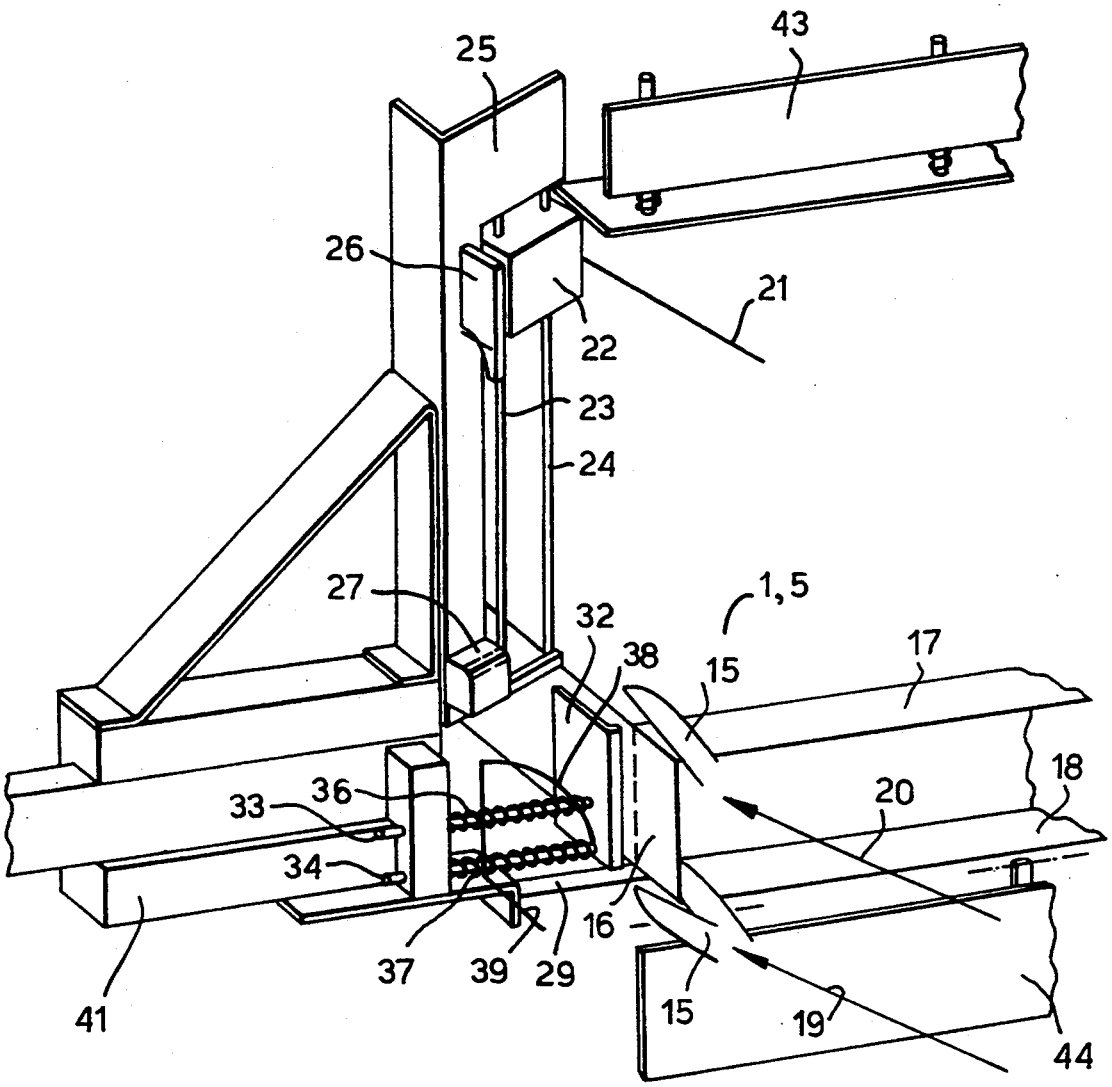
FIG. 11 shows a view similar to that of FIG. 10 with the parts in the cutting phase.
Figure 12:
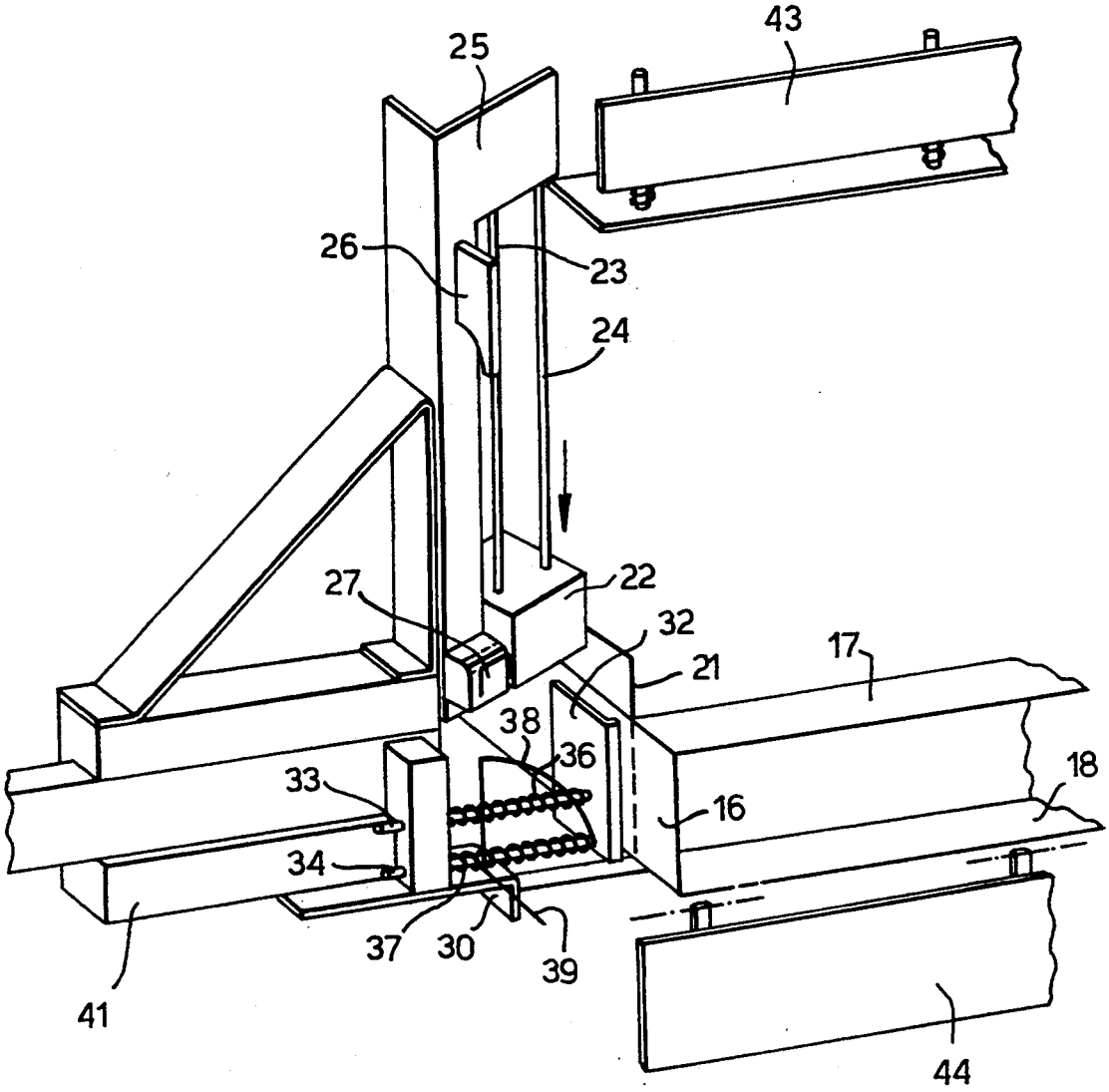
FIG. 12 Shows a view similar to that of FIG. 10 with the corner support in the fold-supporting position.
Figure 13:
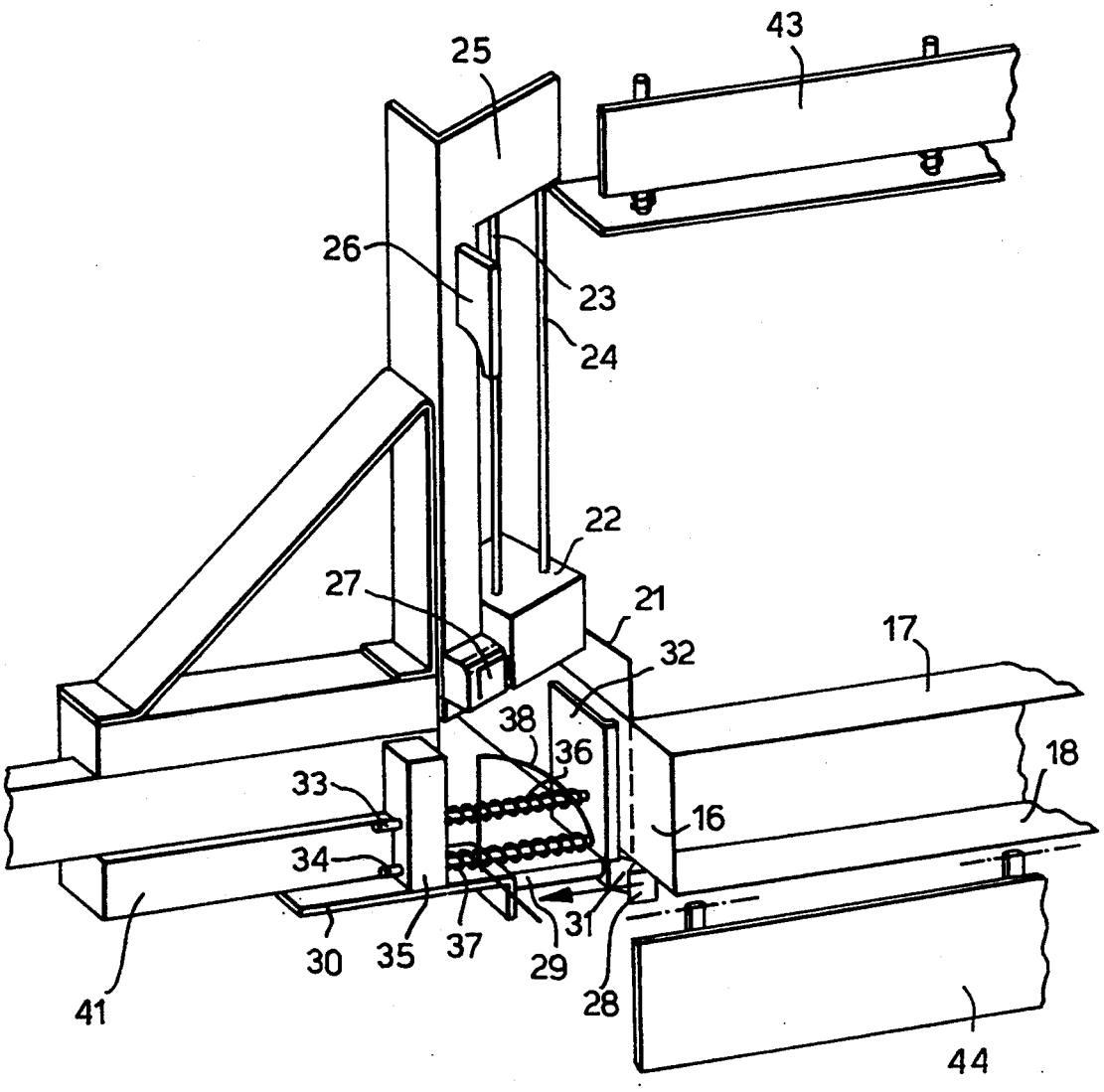
FIG. 13 is a view similar to that of FIG. 12, the needle support being in the needle-supporting position.

After the gluing of the fibre-glass fabric 1 according to FIG. 4, the panel 5 is transported via a table 11 to an end edge infold apparatus 12 which may also be designated a corner folding apparatus. This is illustrated in the assembled state in FIG. 19, and FIGS. 5–18 illustrate parts thereof. According to FIG. 19, the apparatus is provided with a corner module for each corner of the panel 5. This corner module is shown in greater detail in FIG. 9, and parts thereof are shown in greater detail in the other part detail drawings.

The accuracy tolerances in manufacture of the Gullfiber® panels 5 are such that their size may vary by ±5 mm in length and width. In order that the corners be sharp and straight, the apparatus 12 must, therefore, be adjustable to the actual size of the panel 5. In the apparatus illustrated in FIG. 12, this problem has been solved by means of linear units which are adjusted with the aid of pneumatic cylinders after sensing of the size of the panel with the aid of microswitches. Thus, two cylinders 13 and 14 are provided for width adaptation, and cylinders are also provided on the underside for length adaptation to the panel. One corner module may be fixed, while the other three must be displaceable for adaptation to the relevant dimensions of the panel 5. Each corner module has upper and lower pneumatically driven shears 15. The shears 15 are available as complete units, for which reason they are only illustrated schematically in FIG. 11. After cutting of the fibre-glass fabric 1 by the shears 15 in each corner, a corner flap 16 is formed, as well as an upper flap 17 and a lower flap 18. The flaps 16, 17 and 18 can naturally also be designated inward folds. Arrows are employed, like the arrows 19 and 20 in FIG. 11, to illustrate the movement of the components in question in the different Figures, in the direction of each arrow.

In order that the corner of the panel 5 covered with the fibre-glass fabric 1 be sharp and straight, it is appropriate to fold the flap 16 about a support. In this embodiment of the present invention, the support consists of a needle 21 which is shown in greater detail in FIGS. 5–8 and is pivotally disposed in a shift block 22. The block 22 is, in its turn, displaceable up and down along two rods 23 and 24 which are secured in a bracket 25. Pneumatic cylinders are provided (not shown) for moving the block 22 along the rods 23 arid 24. On one side of the block 22, the needle 21 is bent for cooperation with an upper guide cam 26 and a lower guide cam 27, the upper guide cam pivoting the needle 21 to substantially horizontal position according to FIGS. 5 and 6, while the lower guide cam 27 pivots the needle 21 to substantially vertical position in accordance with FIGS. 7 and 8. The position in FIGS. 7 and 8 can, of course, also be considered as at right angles to the position shown in FIGS. 5 and 6. The pivoting of the needle 21 only takes place once the block 22 has reached the guide cam 27 and passed it, to the position illustrated in FIG. 7. Thus, the needle 21 is moved from the position illustrated in FIG. 11 to the position illustrated in FIG. 12. The needle 21 can be assumed to be quite flimsy and easily flexible in the position shown in FIGS. 12 and 13, for which reason there is provided, on the underside of the panel 5, a support and guide piece 28 (FIG. 10) which is disposed on a rod 29 which is guided in an angle bracket 30 and is interconnected to a pneumatic cylinder for switching in the direction of the arrow. The piece 28 is provided with a V-shaped guide groove 31 for accurate positioning of the needle 21. With the aid of the piece 28 and the block 22, the needle 21 will thus, be held in an accurately positioned location for defining a straight and almost exactly placed corner support about which the flap 16 can be folded.

The corner flap 16 is folded with the aid of a corner plate 32 which is displaceable towards and away from the needle 21 under spring loading. The corner plate 32 is secured on the ends of two rods 33 and 34 (FIG. 11) which are displaceable in a frame 35. Between the frame 35 and the corner plate 32 compression springs 36 and 37 are disposed on the rods 33 and 34 for returning to the starting position.

Figure 14:
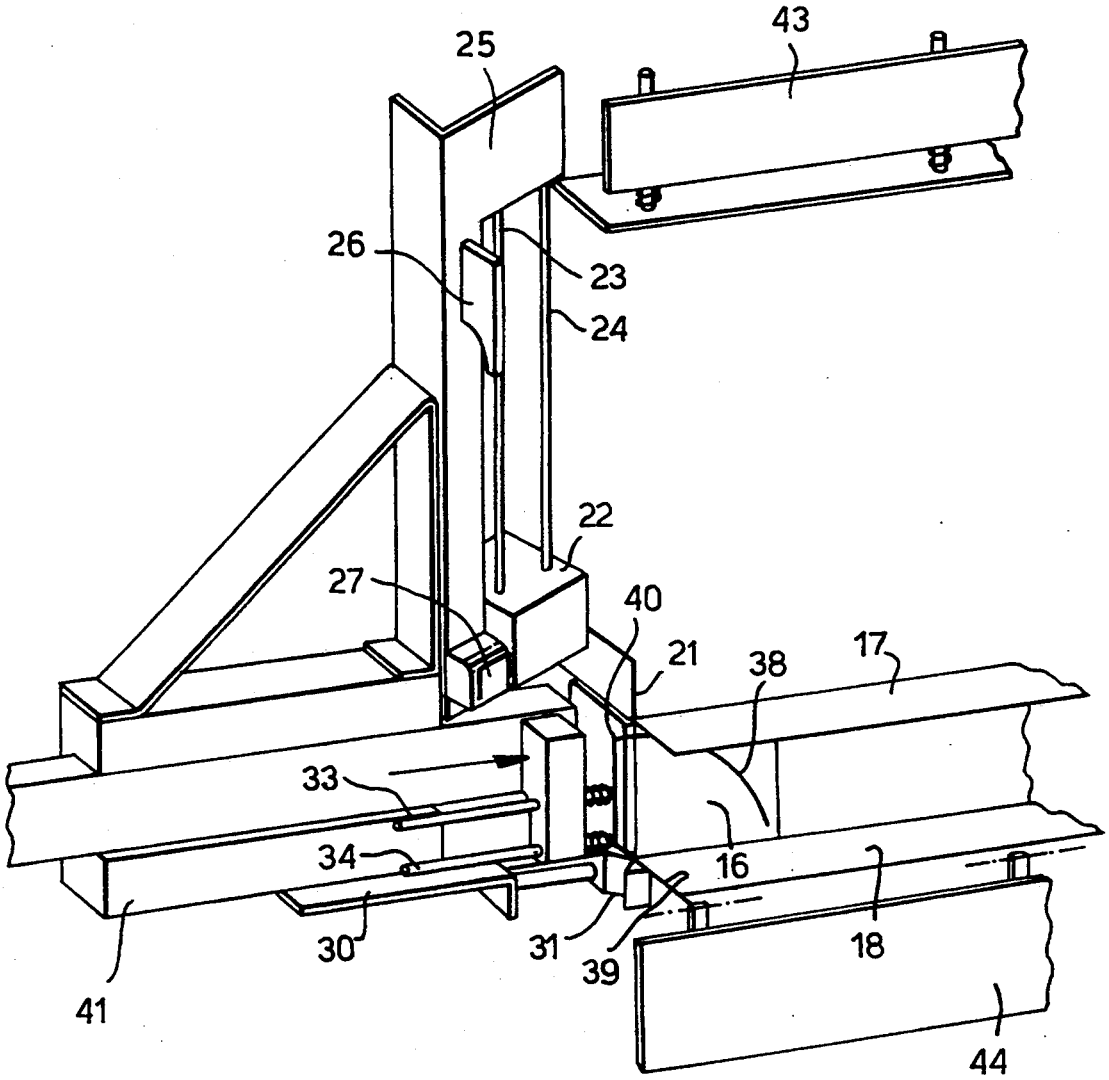
FIG. 14 is a view similar to that of FIG. 10, the stirrup having been switched to the corner flap infold position.
Figure 15:
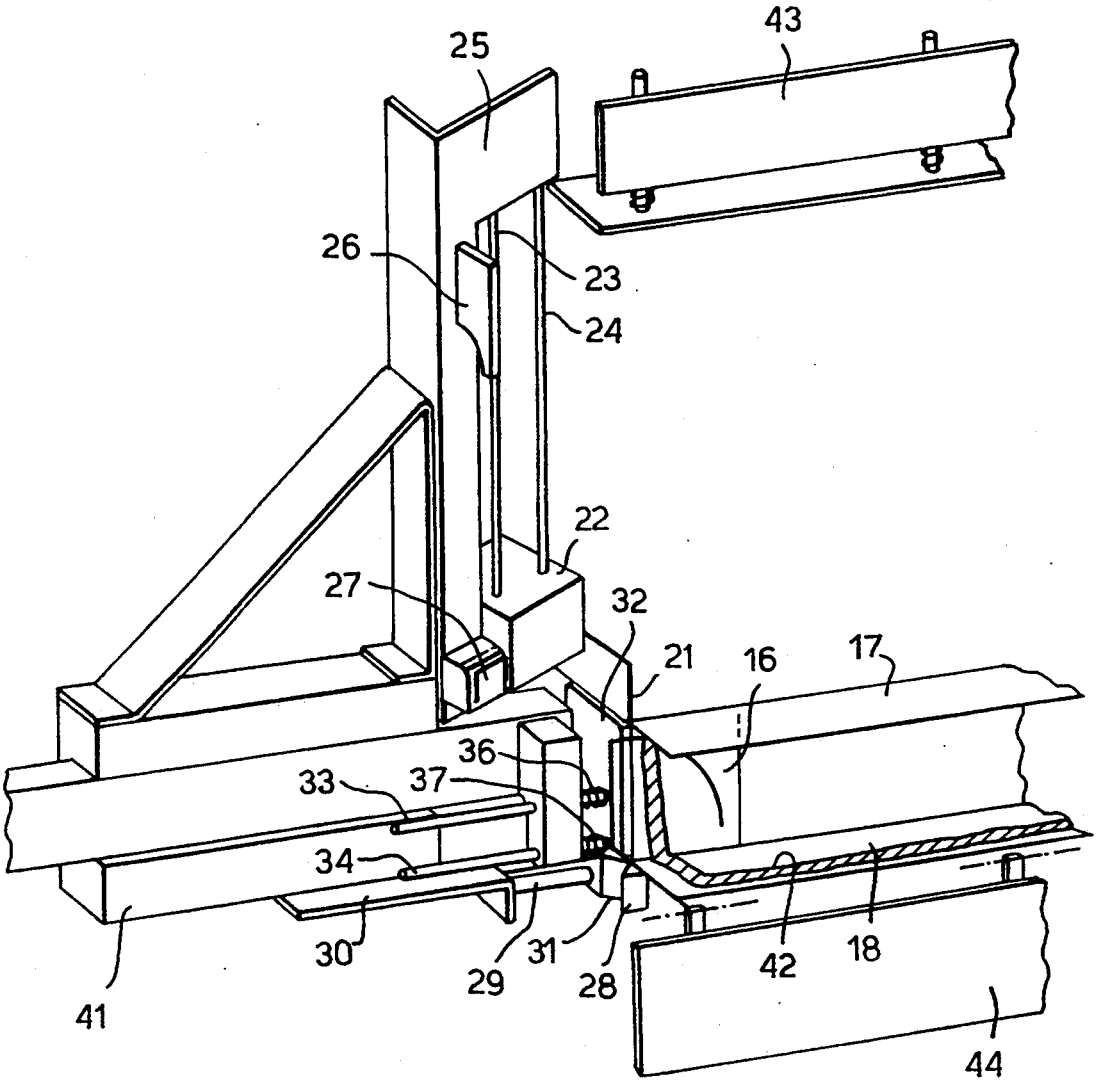
FIG. 15 is a view similar to that of FIG. 14, a glue strand having been applied to the corner flap and the one edge flap or edge infold.
Figure 16:
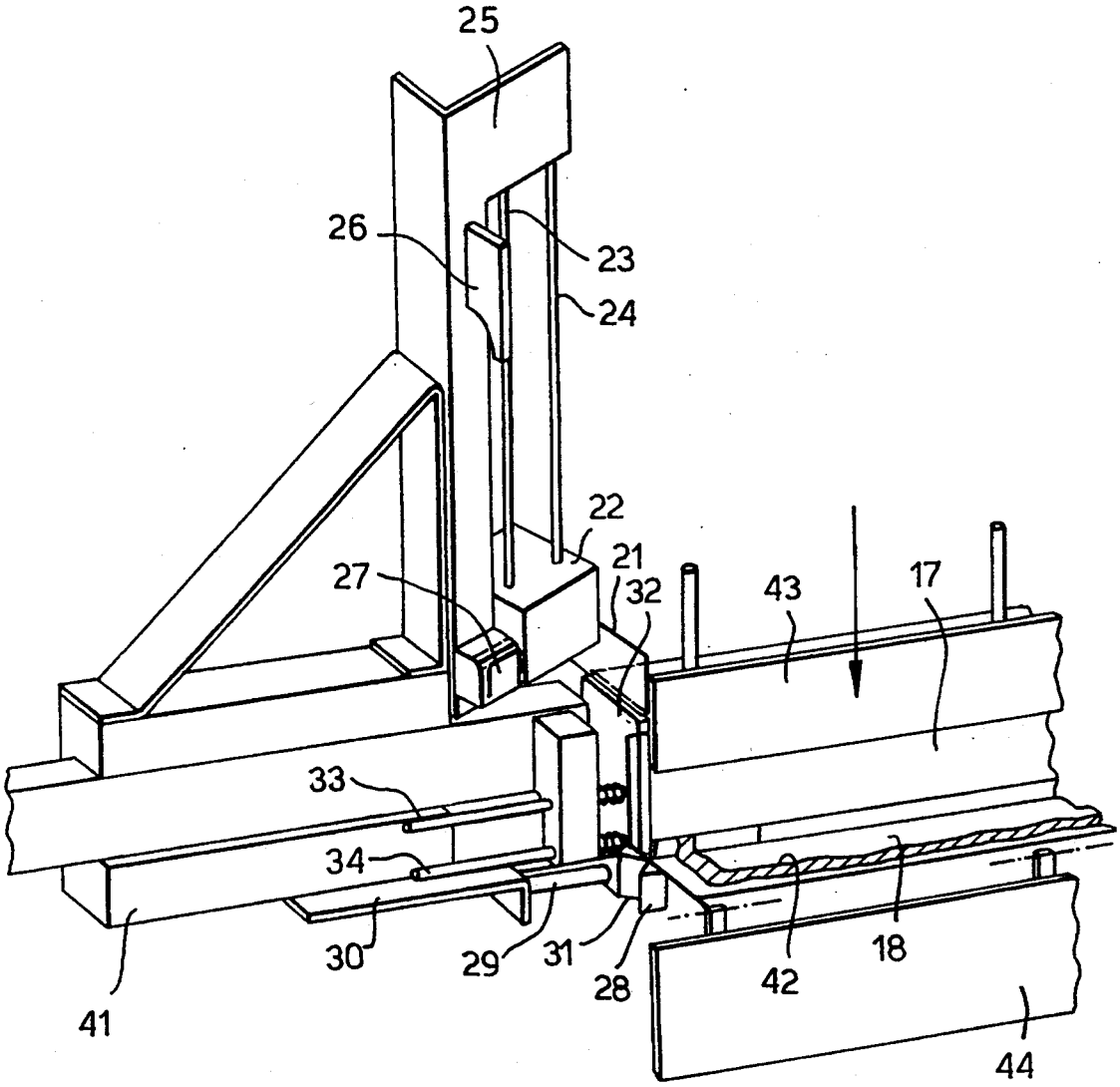

As is apparent in FIG. 14, the entire frame 35 is movable to and away from the needle 21 for urging the corner plate 32 thereagainst and shifting a wire stirrup 38 into the corner and complete inward folding of the corner flap 16 and urging the flap against the end of the panel 5. The insertion of the frame 35 preferably takes place by means of a pneumatic cylinder (not shown). The wire stirrup 38 is pivotal about its lower shank 39 by means of a pneumatic rotary cylinder (not shown) coupled to the lower shank 39 and mounted on a part 41 of the frame 35. With the parts in the position illustrated in FIG. 14, an adhesive strand 42 is applied, as illustrated in FIG. 15 (the adhesive optionally consisting of a suitable hot melt glue). Adhesive strand 42 extends partly on the corner flap 16 and partly on the lower flap 18. After the application of the glue strand 42, an upper folder 43 is displaced downwardly over the flap 17 for folding thereof over the edge surface of the panel 5, whereafter the folder 44 is pivoted upwardly or counterclockwise for inward folding of the flap 18 onto the upper flap 17, whereby the upper flap 17 will partly be glued on the corner flap 16 and the lower flap 18 will be glued partly on the corner flap 16 and partly on the upper flap 17. By such means, there will be obtained a dependable and efficient fixing of the different flaps on one another, whereby the form of the fold will be retained.

Figure 17:
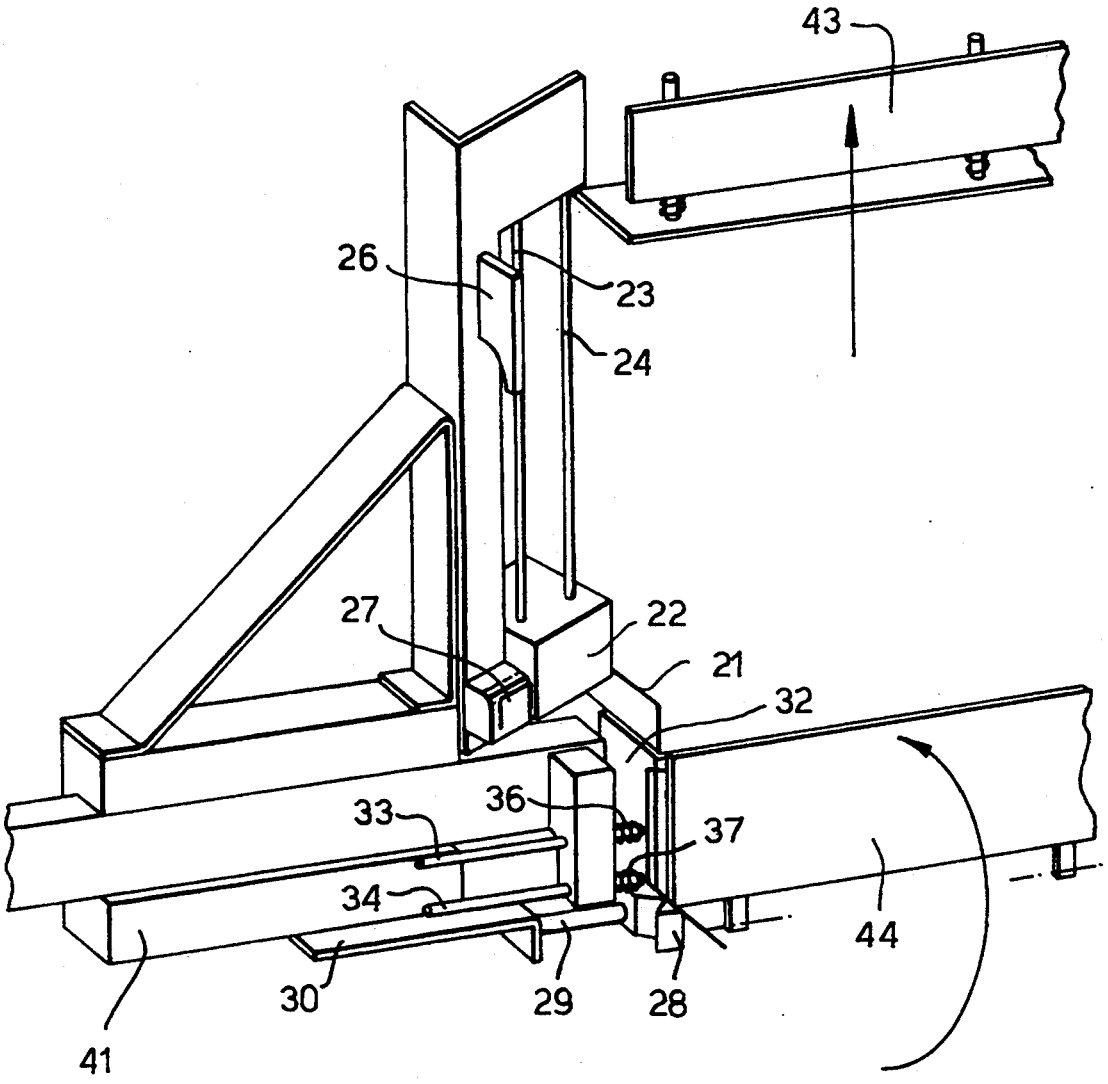
FIG. 17 is a view similar to that of FIG. 16, the lower infolder having been pivoted to the infold position, while the upper infolder has been returned to its starting position.
Figure 18:
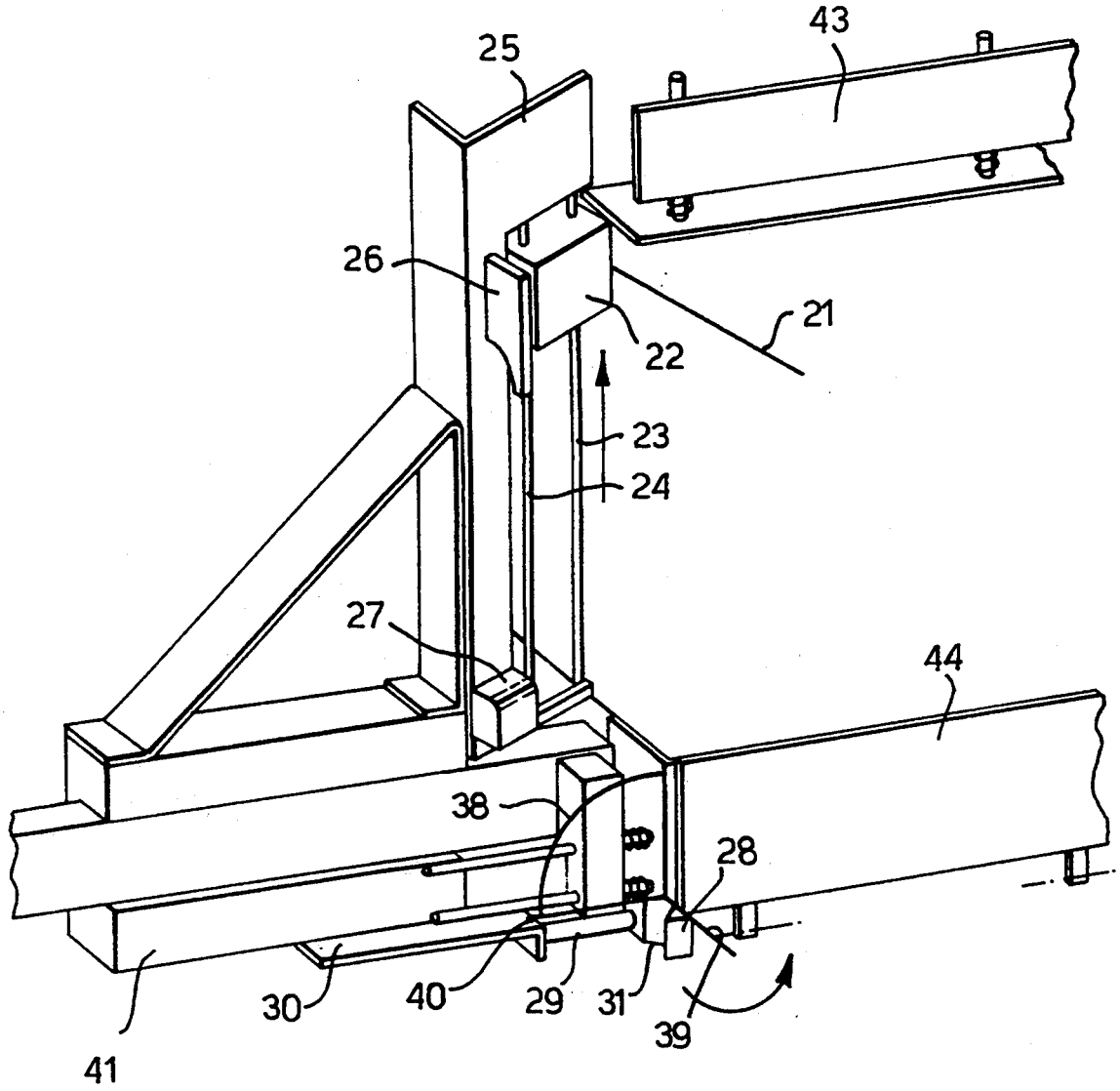
FIG. 18 shows a view similar to that of FIG. 17, the corner support and the stirrup having been returned to their starting position.

After the folding-in of the lower flap 18, the folder 43 is moved back to its upper position (FIG. 17), whereafter the wire stirrup 38 is pivoted from the position illustrated in FIG. 17 to the position illustrated in FIG. 18 and the needle 21 is displaced upwardly to its upper position, whereby both the wire stirrup 38 and the needle 21 will have been extracted from the finished corner without having negatively affected the shape or configuration of the corner in any way whatever.

Figure 19:
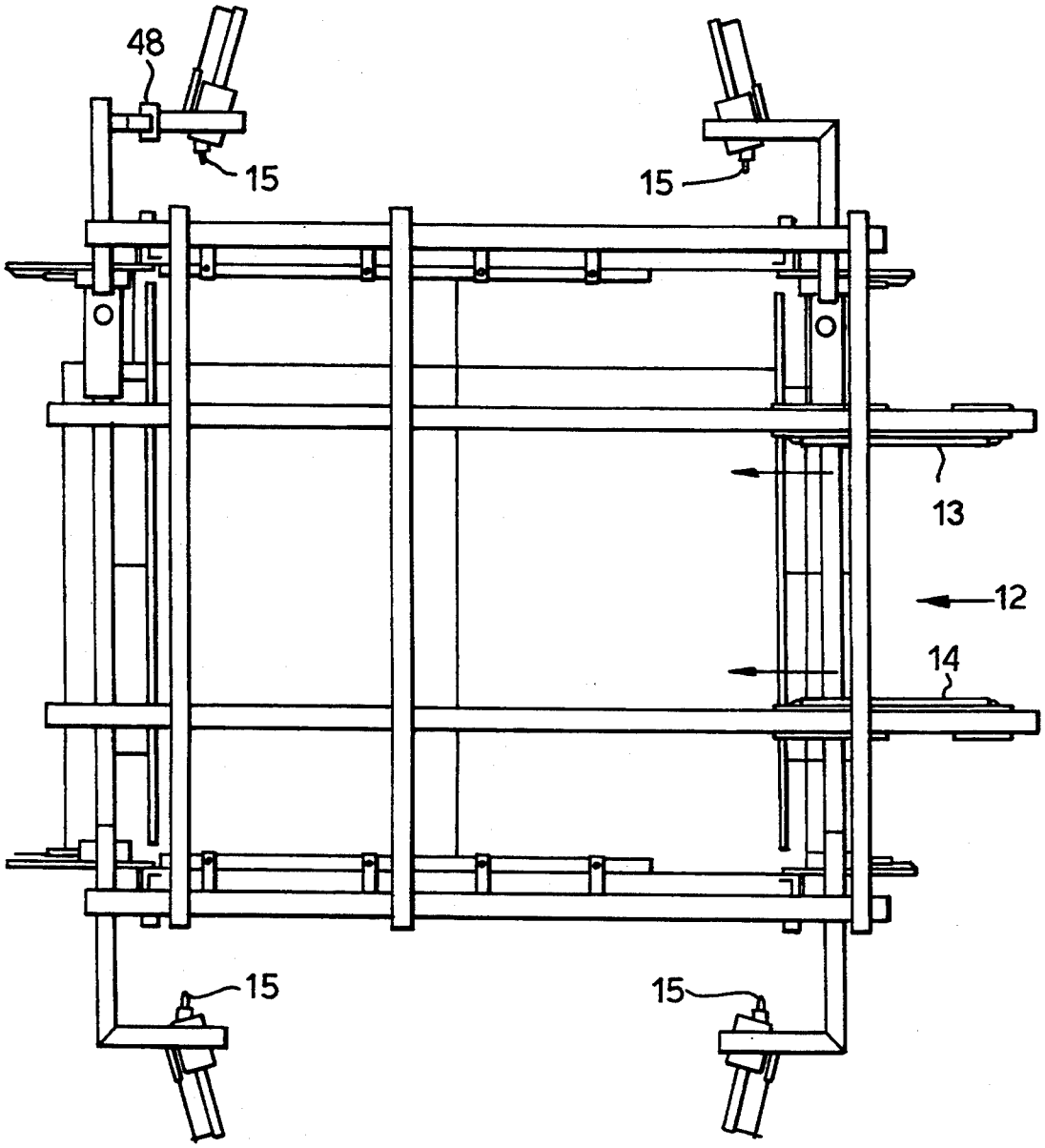
FIG. 19 is a top plan view of an apparatus with four corner modules of the type illustrated in FIGS. 9–18 for simultaneous handling of all four corners of a partly covered panel.

The above-mentioned phases are executed in each corner module, whereby all corners can be finished at the same time. According to FIG. 9, each corner module is displaceable by means of a pneumatic cylinder 45 on a rail 46, in which event the arm 47 carrying the shears 15 is then sectioned. The corner module shown in the upper left-hand corner of FIG. 19 is, moreover, pivotal by means of a hinge 48. The moving parts shown in FIG. 19 are located in a position for a panel 5 with fabric 1 which has minimum dimensions and is urged outwardly by a panel of slightly larger dimensions. After placing of a panel 5 with fabric 1 in position, it is held in place by means of a plate or metal sheet.

While pneumatic cylinders have been mentioned as the means for switching the different parts, there is, of course, nothing to prevent other switching mechanisms from being applied, even though pneumatic cylinders are to be preferred.

The present invention is, naturally, not restricted to the embodiment described in the foregoing, many modifications being conceivable without departing from the spirit and scope of the inventive concept as defined in the appended claims.

We claim:

1. An apparatus for forming corners in a covering for a panel comprising means for positioning the covering to surround the panel and to extend from edges thereoff means for forming at least two first inward folds from two opposing edges of the covering and for causing the first inward folds to overlap one another; means for forming second inward folds from the opposing edges, the second inward folds being located inside the overlapping, first inward folds; a corner support for forming a corner by inward or final folding of the second inward fold about the corner support; an adjustable stirrup for aiding inward folding of the second inward fold about the corner support while leaving exposed an adhesive application surface on the second inward fold; means for applying an adhesive to the adhesive application surface; a first folder for inward folding of a first one of the first inward folds; and a second folder for inward folding of a second one of the first inward folds after application of adhesive on the adhesive application surface.

2. The apparatus as claimed in claim 1 wherein the corner support comprises a rod, and a needle pivotally and displaceably disposed on the rod so that in a supporting position of the needle in the corner, the needle extends along the corner.

3. The apparatus as claimed in claim 2, wherein the corner support further comprises a needle support, and wherein the needle is longer than the corner so as to extend past the corner for cooperation with the needle support to retain the needle in a desired position in the corner.

4. The apparatus as claimed in claim 3, wherein the needle support is displaceable to and from the position supporting the needle.

5. The apparatus as claimed in claim 1, wherein the stirrup is a wire stirrup and is switchable past the corner, for inward folding of the second inward fold about the corner support, and back to its starting position in a path outside the adhesive application surface.

6. The apparatus as claimed in claim 5, further comprising a corner-forming plate, and wherein the wire stirrup is disposed to cooperate with the corner-forming plate to urge the second inward fold against the corner support.

7. The apparatus as claimed in claim 5, wherein the wire stirrup is insertable past the corner and is pivotal out therefrom for returning to its starting position.

8. The apparatus as claimed in claim 1, further comprising displaceable shears disposed in each corner for cutting the covering and forming the inward folds or flaps.

9. The apparatus as claimed in claim 6 wherein the wire stirrup is insertable past the corner and is pivotal out therefrom for returning to its starting position.

10. The apparatus as claimed in any one of claim 1–8 or 9, further comprising a piston and cylinder assembly interconnecting the corner support and the stirrup to provide desired switching thereof.

* * * * *